US011346635B2

(12) United States Patent
Rorick et al.

(10) Patent No.: US 11,346,635 B2
(45) Date of Patent: May 31, 2022

(54) HOLSTER

(71) Applicant: Surefire, LLC, Fountain Valley, CA (US)

(72) Inventors: Steven Rorick, Fountain Valley, CA (US); John W. Matthews, Fountain Valley, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

(21) Appl. No.: 16/475,359

(22) PCT Filed: Jan. 12, 2018

(86) PCT No.: PCT/US2018/013599

§ 371 (c)(1),
(2) Date: Jul. 1, 2019

(87) PCT Pub. No.: WO2018/132724

PCT Pub. Date: Jul. 19, 2018

(65) Prior Publication Data

US 2019/0346233 A1 Nov. 14, 2019

Related U.S. Application Data

(60) Provisional application No. 62/446,184, filed on Jan. 13, 2017.

(51) Int. Cl.

| | |
|---|---|
| ***F41C 33/04*** | (2006.01) |
| ***F41C 33/02*** | (2006.01) |
| *F41G 1/35* | (2006.01) |

(52) U.S. Cl.

CPC ..... *F41C 33/0254* (2013.01); *F41C 33/0236* (2013.01); *F41C 33/04* (2013.01); *F41G 1/35* (2013.01)

(58) Field of Classification Search

CPC .. F41C 33/0254; F41C 33/0236; F41C 33/04; F41G 1/35

(Continued)

(56) References Cited

U.S. PATENT DOCUMENTS 2,336,718 A * 12/1943 Howlett ..... F41G 1/35 356/247
3,550,822 A * 12/1970 Lloyd ..... F41C 33/0245 224/193

(Continued)

FOREIGN PATENT DOCUMENTS

CN 205664717 10/2016

OTHER PUBLICATIONS

Chinese Office Action for China Patent Application No. 201880006399.0 dated Jun. 3, 2021, English translation, 14 pages.

*Primary Examiner* — Peter N Helvey
(74) *Attorney, Agent, or Firm* — Haynes and Boone, LLP

(57) ABSTRACT

The present disclosure relates to a holster, comprising a control component, wherein the holster is adapted to allow a user the option of drawing a weapon and an accessory attached to the weapon. Further disclosed herein is a holster, comprising a control component adapted to receive a handgun assembly comprising a handgun and a light accessory attached to the handgun, and further comprising one or more actuators, wherein the one or more actuators are capable of moving between a neutral position and an engaged position, as the handgun assembly is inserted into the holster, retained in the holster, or drawn from the holster. Also disclosed herein are methods of using the holster.

62 Claims, 9 Drawing Sheets

(58) Field of Classification Search
USPC ..... 224/576
See application file for complete search history.

(56) References Cited

U.S. PATENT DOCUMENTS 4,713,889 A * 12/1987 Santiago ..... F41C 33/0227 224/246
4,912,867 A * 4/1990 Dukes, Jr. ..... F41A 17/54 224/238
5,598,958 A * 2/1997 Ryan, III ..... F41C 33/0245 224/198
6,112,962 A * 9/2000 Matthews ..... F41C 33/0236 224/191
6,267,279 B1 * 7/2001 Matthews ..... F41C 33/0236 224/191
7,395,627 B2 * 7/2008 La France ..... F41G 11/003 362/110
7,735,255 B1 * 6/2010 Kincaid ..... F41C 33/041 42/146
8,215,525 B2 * 7/2012 Rassias ..... F41C 33/041 224/245
8,602,276 B2 * 12/2013 Tyybakinoja ..... F41C 33/0263 224/244
2005/0224537 A1 * 10/2005 Rassias ..... F41C 33/0218 224/243
2006/0026886 A1 * 2/2006 Doukas ..... F41C 33/0254 42/117
2006/0157520 A1 * 7/2006 Clifton, Jr. ..... F41A 17/00 224/243
2006/0226185 A1 * 10/2006 Har-Shen ..... F41C 33/0263 224/244
2008/0110947 A1 * 5/2008 Pikielny ..... F41C 33/0209 224/243
2008/0121670 A1 * 5/2008 Buress ..... F41C 33/0263 224/243
2010/0064568 A1 * 3/2010 NuDyke ..... F41A 17/06 42/117
2011/0011904 A1 * 1/2011 Schultz ..... F41C 33/0263 224/244
2012/0097718 A1 * 4/2012 Baumann ..... F41C 33/0263 224/193
2013/0301243 A1 * 11/2013 Rorick ..... F41G 1/00 362/110
2015/0184978 A1 * 7/2015 Hedeen ..... F41C 33/0263 42/114
2016/0165192 A1 * 6/2016 Saatchi ..... F41C 33/029 386/227

* cited by examiner

HOLSTER

CROSS REFERENCE TO RELATED APPLICATIONS

This application is a National Phase of International Application No. PCT/US2018/13599, filed Jan. 12, 2018, which designated the U.S. and that International Application was published under PCT Article 21(2) in English. This application also includes a claim of priority under 35 U.S.C. § 119(e) to U.S. Provisional Application No. 62/446,184, filed Jan. 13, 2017, the entirety of which is hereby incorporated by reference.

FIELD OF THE INVENTION

The present invention relates generally to firearms and, more particularly, to devices and systems of carry of firearms and light accessories.

BACKGROUND OF THE DISCLOSURE

Holsters for carrying a handgun on the person of a wearer is widely known in the field. There are several advantages of carrying a handgun in a holster. A holster may protect the trigger, which helps lower the risk of negligent discharge. A holster may also be helpful in maintaining the position of the handgun for consistent access. Moreover, a holster may help in ensuring that a gun remains safely in the wearer's possession. In some cases handguns may be equipped with an accessory, such as a gun mounted light, for example, which enhance the user's ability to identify and engage a potential target. In those cases, it is desirable to have a holster that can accommodate the handgun equipped with the accessory, as well as allow greater control and flexibility of use for the accessory, such as features that include an auto-shut off of a light accessory when the handgun is holstered. It is also advantageous if the holster has a quick, short and reliable draw.

Thus, a need exists for holsters that can accommodate instruments such as handguns with light accessories, which allow both the handgun to be drawn from the holster in a quick and reliable fashion, while at the same time, allowing the user flexibility and control of the light accessory.

SUMMARY OF THE DISCLOSURE

Various embodiment herein include a holster, comprising: a control component; wherein the holster is adapted to allow a user the option of drawing a weapon and an accessory attached to the weapon. Various embodiments herein also include a holster, comprising a control component and a selector, wherein the selector is adapted to allow a user the option of drawing a weapon and an accessory attached to the weapon. In one embodiment, the weapon is a handgun. In another embodiment, the weapon is a Taser. In one embodiment, the accessory is a light accessory. In one embodiment, the light in the light accessory is in the off position when the handgun is in the holster. In one embodiment, the light in the light accessory is in the off or on position when the handgun is withdrawn from the holster. In one embodiment, the control component further comprises one or more actuators. In one embodiment, the control component comprises an on actuator and an off actuator. In one embodiment, the on actuator is attached to the control component by a on actuator spring support. In one embodiment, the off actuator is attached to the control component by an off actuator spring retainer. In one embodiment, the holster is described in FIG. 1-16 herein. In one embodiment, the selector is adapted to receive a light accessory which has been attached to a handgun. In one embodiment, the selector is attached to a light accessory which has been attached to a handgun. In one embodiment, the holster allows for a straight draw or return of a handgun, no rotation is necessary. In one embodiment, the actuator can be restrained from effecting the on switch function.

Various embodiments herein also include a holster, comprising: a control component comprising one or more actuators; wherein the holster is adapted to receive a handgun assembly comprising a handgun and a light accessory attached to the handgun; and wherein the one or more actuators are capable of moving between a neutral position and an engaged position, as the handgun assembly is inserted into the holster, retained in the holster, or drawn from the holster. In one embodiment, a movement in the one or more actuators moves a switch in the light accessory to an off or on position as the handgun assembly is inserted into the holster, retained in the holster, or drawn from the holster. In one embodiment, the light accessory remains in the on or off position when the gun is drawn. In one embodiment, the light accessory remains in the off position when the handgun is in the holster. In one embodiment, the holster allows for a straight draw of the handgun. In one embodiment, the holster is described in FIG. 1-16 herein.

Various embodiments herein further include a method comprising: inserting a handgun assembly into a holster, wherein the handgun assembly comprises a handgun and a light accessory attached to the handgun, and wherein the holster comprises a control component and a selector; and moving a switch of the light accessory to an off position in response to the inserting, wherein the moving is performed by a structure protruding from the control box; wherein the handgun assembly and holster allows for a straight draw of the handgun. In one embodiment, the light accessory remains in the off position or moves to the on position once the handgun is withdrawn from the holster.

Other embodiments include a device comprising a control component, and a selector, where the selector is adapted to allow a user the option of drawing from the device a weapon and a light accessory with the light either off or activated on, and the light is off when the handgun is returned to the device. In another embodiment, the selector allows the holster to be configured for either a left or right handed user.

Other embodiments include a device comprising a control component adapted to allow a user the option of drawing from the device a light apparatus that can be turned off or activated on, and an auto-shut off feature so that the light apparatus is off when returned to the device. In another embodiment, the device is made of a plastic material. In another embodiment, the device includes one or more of the following materials: polyphenylene sulfide (PPS), polyethylene terephthalate, polyetheretherketone, polybutylene terephthalate, Ertalyte TX, PEEK, Torlon, Delrin, PET, Vespel, and Duratrol. In another embodiment, the device is made from a Delrin mold.

Other features and advantages of the invention will become apparent from the following detailed description, taken in conjunction with the accompanying drawings, which illustrate, by way of example, various embodiments of the invention.

DESCRIPTION OF THE DRAWINGS

Exemplary embodiments are illustrated in referenced figures. It is intended that the embodiments and figures disclosed herein are to be considered illustrative, rather than restrictive.

DETAILED DESCRIPTION

Figure 1:
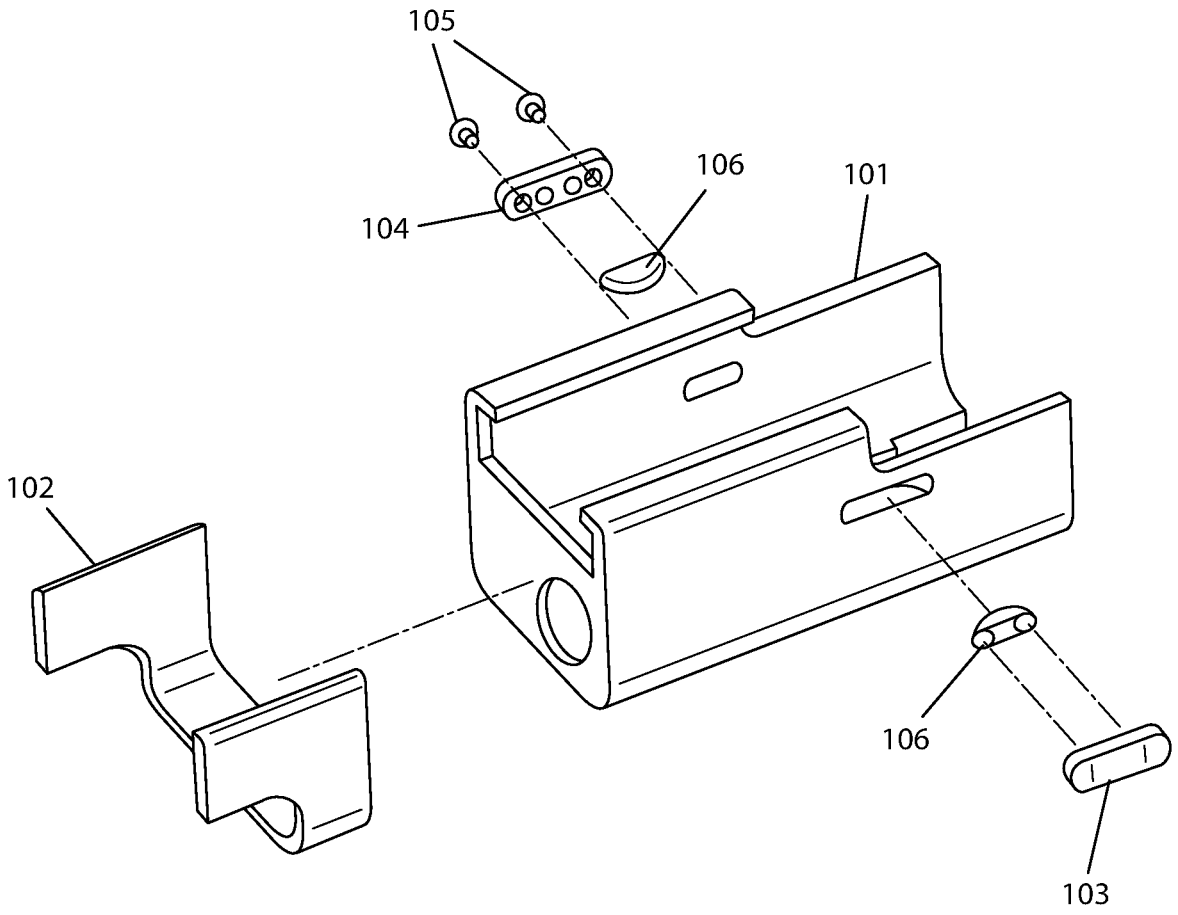
FIG. 1 illustrates, with accordance with embodiments herein, one embodiment of the holster disclosed herein showing the exploded parts view. In one embodiment, as described herein, the Selector component allows the holster to be configured to allow a user to be both left or right handed. In another embodiment, as depicted in FIG. 1, a battery cap hole in the control box is provided.

All references, publications, and patents cited herein are incorporated by reference in their entirety as though they are fully set forth. Unless defined otherwise, technical and scientific terms used herein have the same meaning as commonly understood by one of ordinary skill in the art to which this invention belongs. One skilled in the art will recognize many methods and materials similar or equivalent to those described herein, which could be used in the practice of the present invention. Indeed, the present invention is in no way limited to the methods and materials described.

As used herein, the terms "control box," and "control component" are terms that may be used interchangeably, and the invention is in no way limited to only components or control boxes that have a box-like configuration. As readily apparent to one of skill in the art, and in accordance with various embodiments herein, the control box or control component may come in any variety of shapes and configurations and is in no way limited to only the box diagrams or explicit shapes described herein.

As described herein, various embodiments describe a device, such as a holster, that may be used in conjunction with a weapon. In one embodiment, the weapon may be mounted with an accessory, such as, for example, a light accessory, a silencer, a laser and the like. In one embodiment, the inventors have developed a device designed to accept most pistols that allow fitment of the Surefire XC-1 weapons light currently in production, and will support pistol mounted suppressors without increasing the uniquely short draw length. In one embodiment, the device is both right and left hand compatible, and controls the XC-1 lights on/off function as drawn selectively without preparing XC-1 or chosen pistol. In one embodiment, the XC-1H holster would allow a variety of carry options, such as concealed and open carry.

Various embodiment herein include a holster, comprising: a control component, or control box 101, wherein the holster is adapted to allow a user the option of drawing a weapon and an accessory 107 attached to the weapon. In another embodiment, the present disclosure provides a holster, comprising a control component and a selector 102, wherein the selector 102 is adapted to allow a user the option of drawing a weapon and an accessory 107 attached to the weapon. In one embodiment, the weapon is a handgun. In another embodiment, the weapon is a Taser. In one embodiment, the accessory 107 is a light accessory 107. In one embodiment, the light in the light accessory 107 is in the off position when the handgun is in the holster. In one embodiment, the light in the light accessory 107 is in the off or on position when the handgun is withdrawn from the holster. In one embodiment, the control component further comprises one or more actuators 106. In one embodiment, the control component comprises an on actuator 106 and an off actuator 106. In one embodiment, the on actuator 106 is attached to the control component by an on actuator spring support 103. In one embodiment, the off actuator 106 is attached to the control component by an off actuator spring retainer 104. In one embodiment, the holster is described in FIGS. 1-15 herein. In one embodiment, the holster is adapted to receive a light accessory 107 which has been attached to a handgun. In one embodiment, the selector is attached to a handgun. In one embodiment, the holster allows for a straight draw or return of a handgun, no rotation is necessary. In one embodiment, the actuator can be restrained from effecting the on switch function.

In another embodiment, the present disclosure provides a holster, comprising (a) a selector 102 adapted to receive a handgun assembly comprising a handgun and a light accessory 107 attached to the handgun, and (b) a control component comprising one or more actuators 106, wherein the one or more actuators 106 are capable of moving between a neutral position and an engaged position, as the handgun assembly is inserted into the holster, retained in the holster, or drawn from the holster. In one embodiment, a movement in the one or more actuators 106 moves a switch in the light accessory 107 to an off or on position as the handgun assembly is inserted into the holster, retained in the holster, or drawn from the holster. In one embodiment, the light accessory 107 remains in the on or off position when the gun is drawn. In one embodiment, the light accessory 107 remains in the off position when the handgun is in the holster. In one embodiment, the holster allows for a straight draw of the handgun. In one embodiment, the holster is described in FIGS. 1-16 herein.

In another embodiment, the present disclosure provides a method comprising: inserting a handgun assembly into a holster, wherein the handgun assembly comprises a handgun and a light accessory 107 attached to the handgun, and wherein the holster comprises a control component and a selector 102; and moving a switch of the light accessory 107 to an off position in response to the inserting, wherein the moving is performed by a structure protruding from the control box; wherein the handgun assembly and holster allows for a straight draw of the handgun. In one embodiment, the light accessory 107 remains in the off position or moves to the on position once the handgun is withdrawn from the holster.

Figure 2:
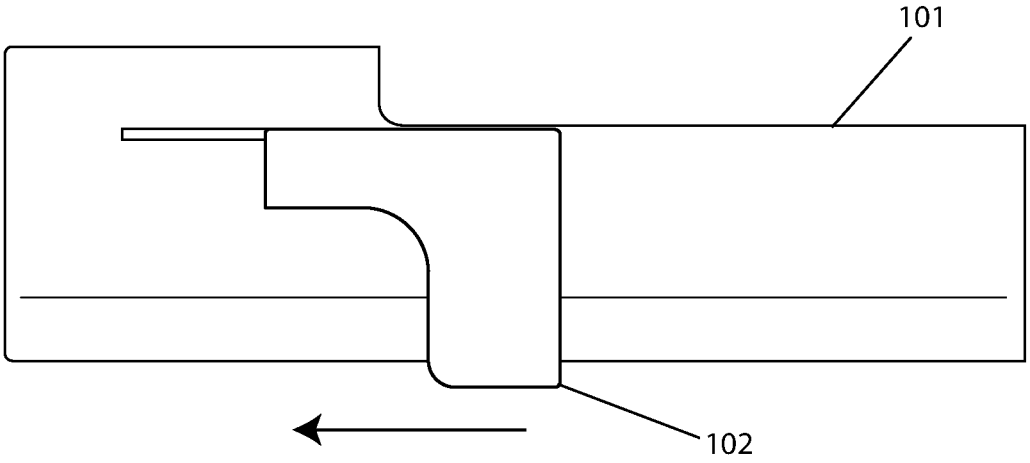
FIG. 2 illustrates, with accordance with embodiments herein, one embodiment of the holster disclosed herein showing the selector in OFF position.
Figure 3:
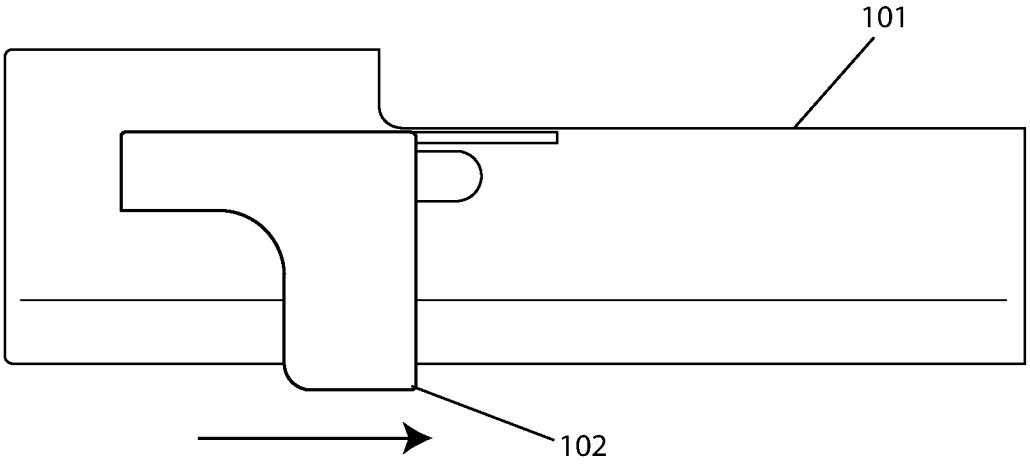
FIG. 3 illustrates, with accordance with embodiments herein, one embodiment of the holster disclosed herein showing the selector in ON position.
Figure 4:
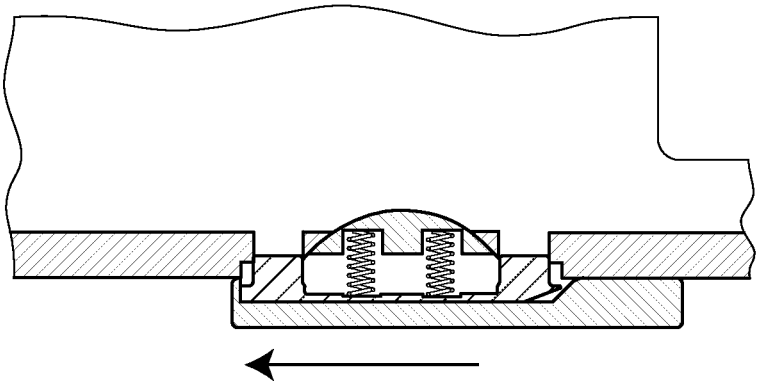
FIG. 4 illustrates, with accordance with embodiments herein, one embodiment of the holster disclosed herein showing the left side in OFF position.
Figure 5:
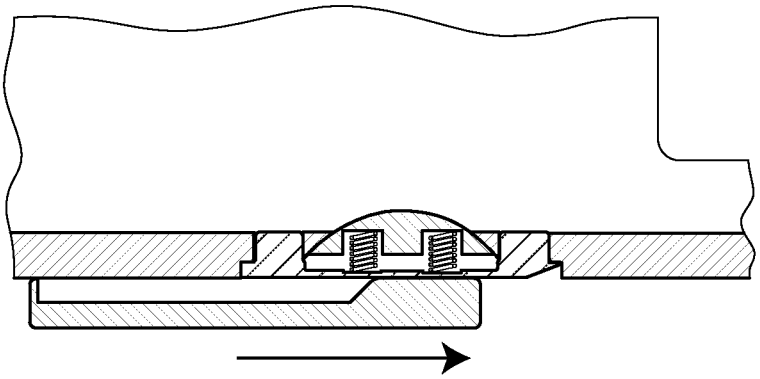
FIG. 5 illustrates, with accordance with embodiments herein, one embodiment of the holster disclosed herein showing the left side in ON position.
Figure 6:
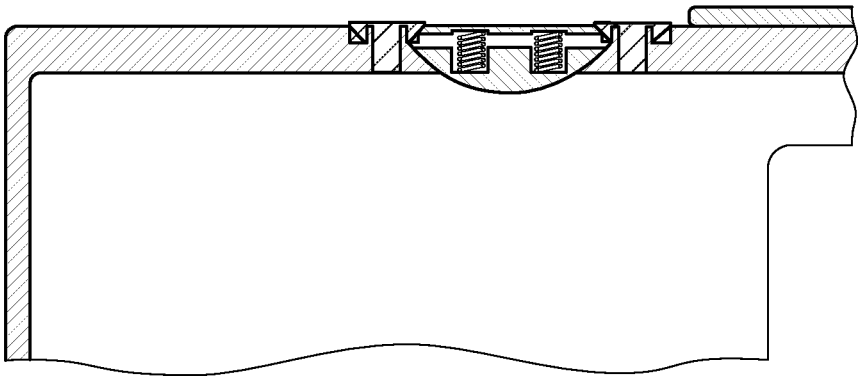
FIG. 6 illustrates, with accordance with embodiments herein, one embodiment of the holster disclosed herein, showing the off actuator and right side fixed bias.
Figure 7:
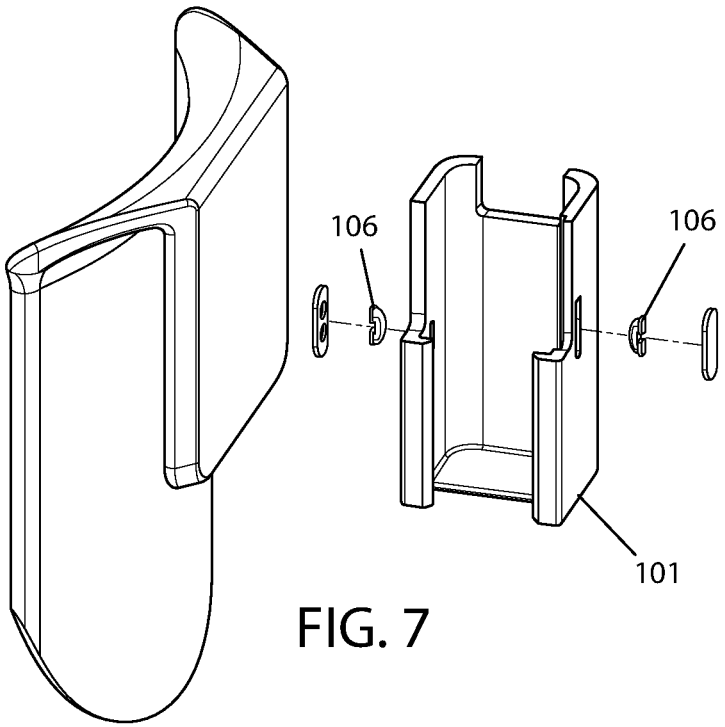
FIG. 7 illustrates, with accordance with embodiments herein, one embodiment of the holster disclosed herein showing the control box with mount assembly.
Figure 8:
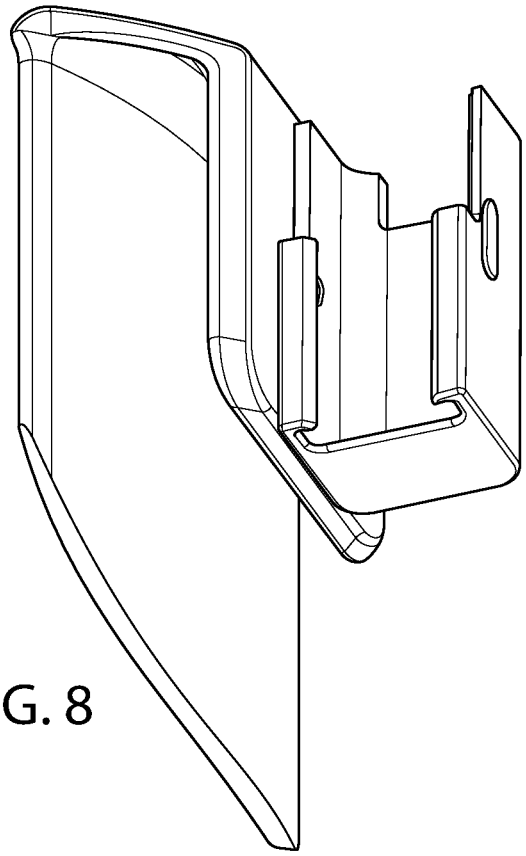
FIG. 8 illustrates, with accordance with embodiments herein, one embodiment of the holster disclosed herein showing the control box with mount assembly.
Figure 9:
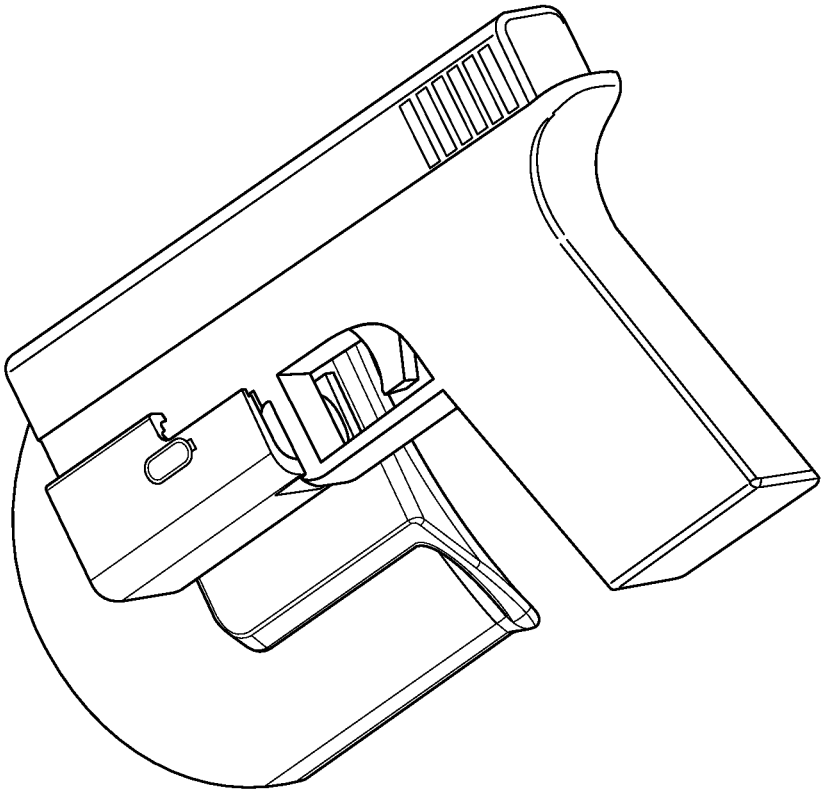
FIG. 9 illustrates, with accordance with embodiments herein, one embodiment of the holster disclosed herein showing the control box with mount assembly.
Figure 10:
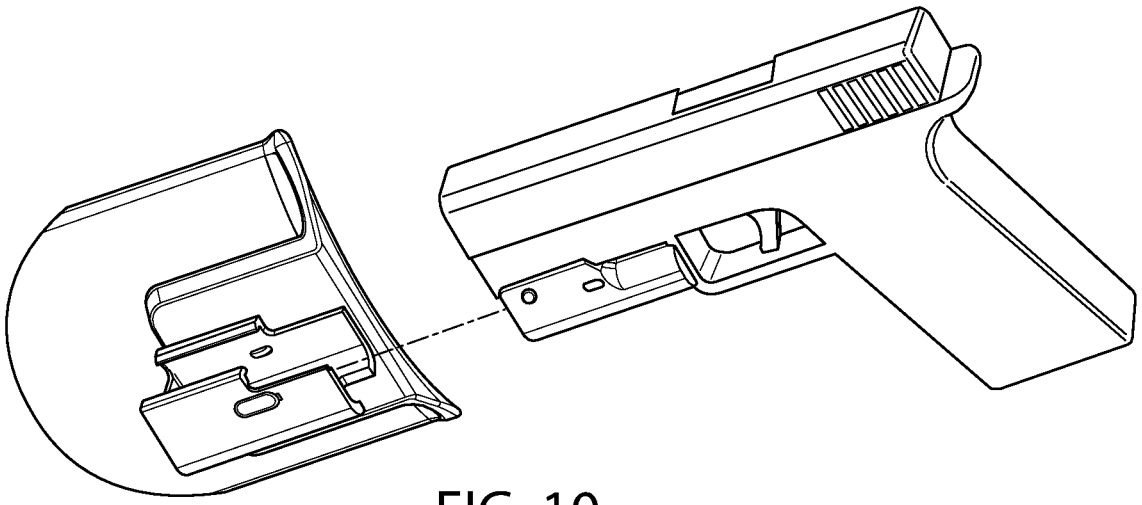
FIG. 10 illustrates, with accordance with embodiments herein, one embodiment of the holster disclosed herein showing the control box with mount assembly.
Figure 11:
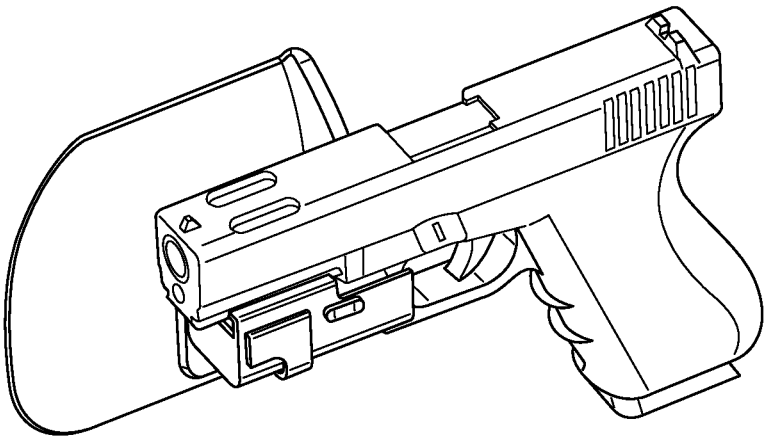
FIG. 11 illustrates, with accordance with embodiments herein, one embodiment of the holster disclosed herein with a handgun.
Figure 12:
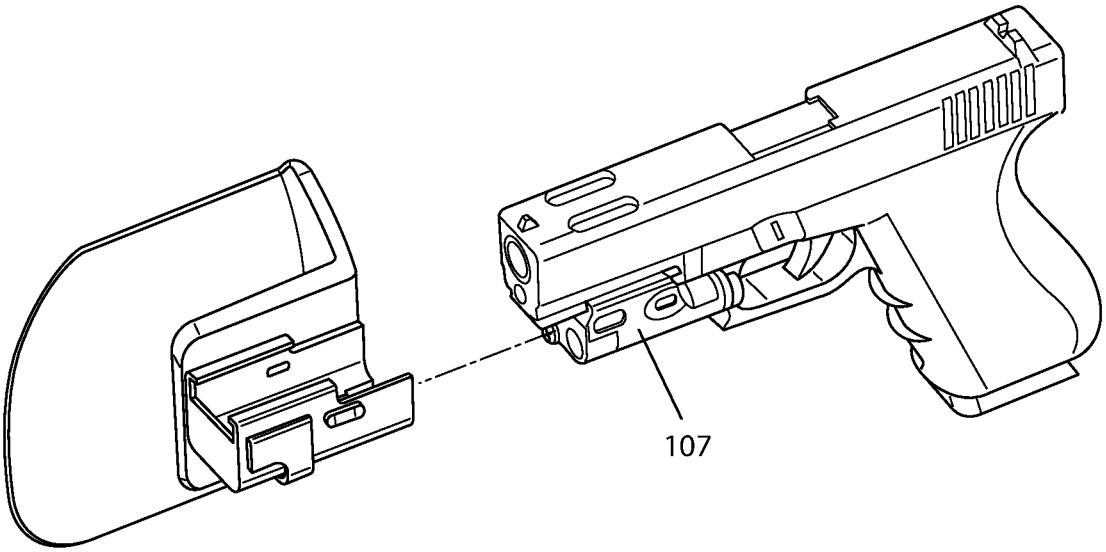
FIG. 12 illustrates, with accordance with embodiments herein, one embodiment of the holster disclosed herein with a handgun.
Figure 13:
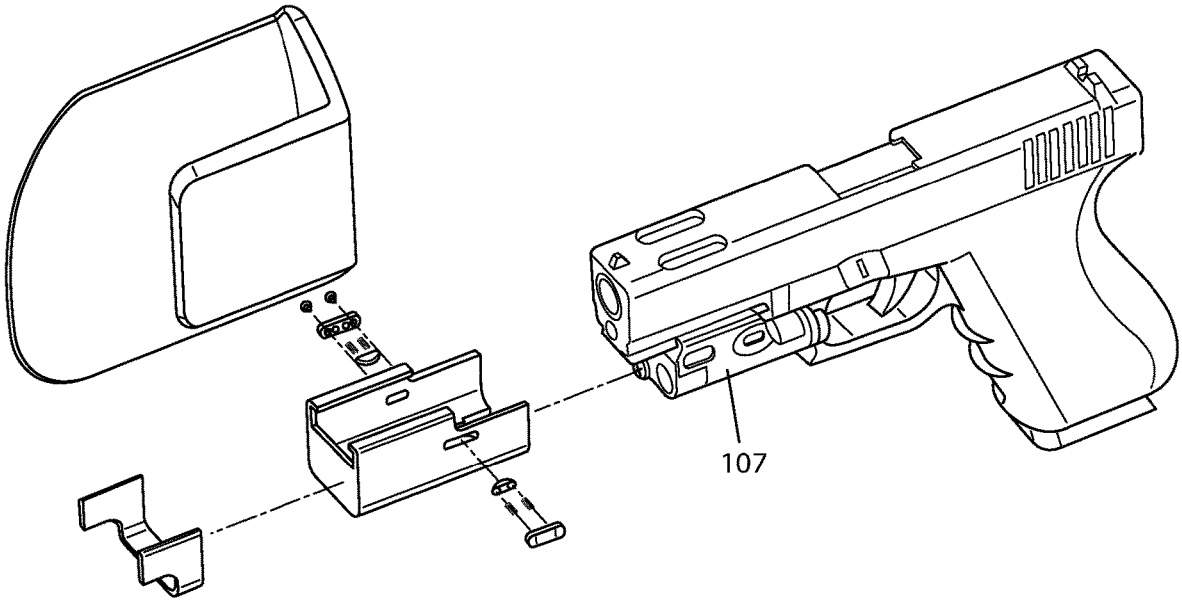
FIG. 13 illustrates, with accordance with embodiments herein, one embodiment of the holster disclosed herein with a handgun.
Figure 14:
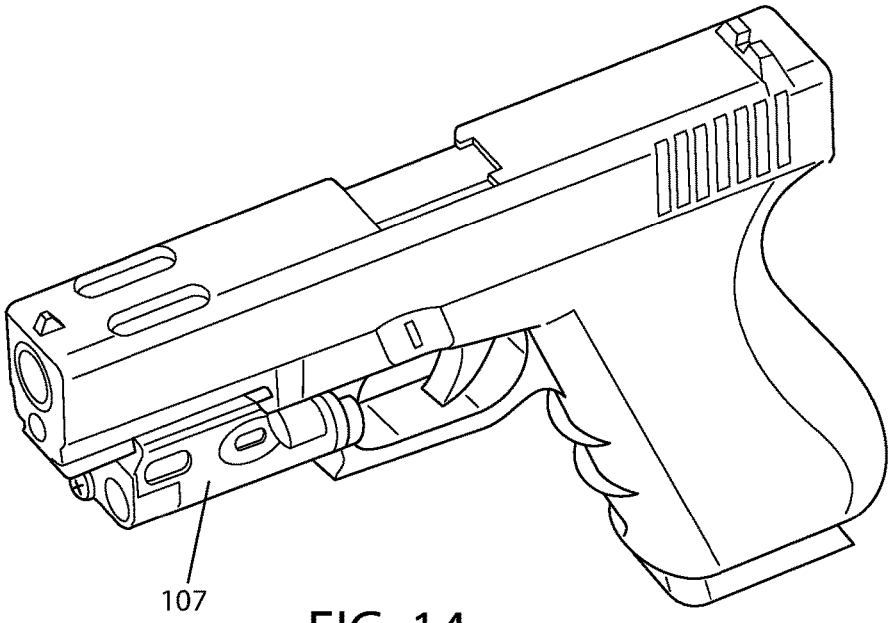
FIG. 14 illustrates, with accordance with embodiments herein, one embodiment of the holster disclosed herein with a handgun.
Figure 15:
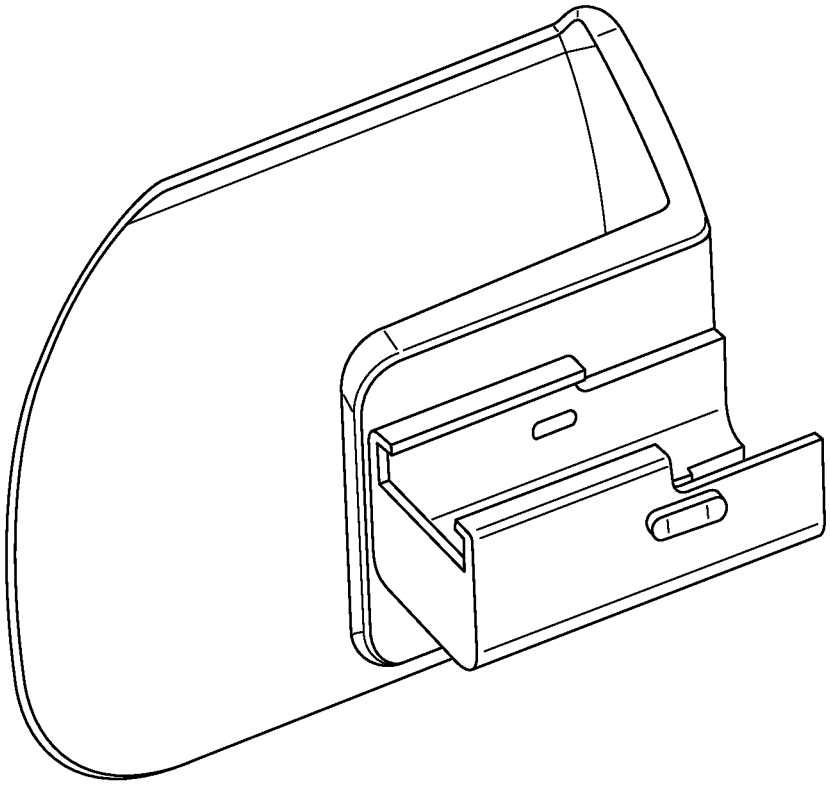
FIG. 15 illustrates, with accordance with embodiments herein, one embodiment of the holster disclosed herein with a handgun.
Figure 16C:
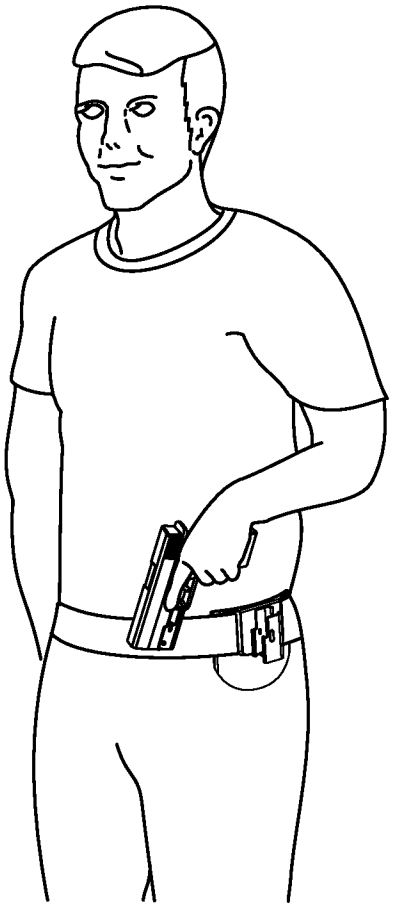
FIG. 16 illustrates, with accordance with embodiments herein, one embodiment of the holster disclosed herein where a person is wearing it (A) and using it (B and C).
Figure 16B:
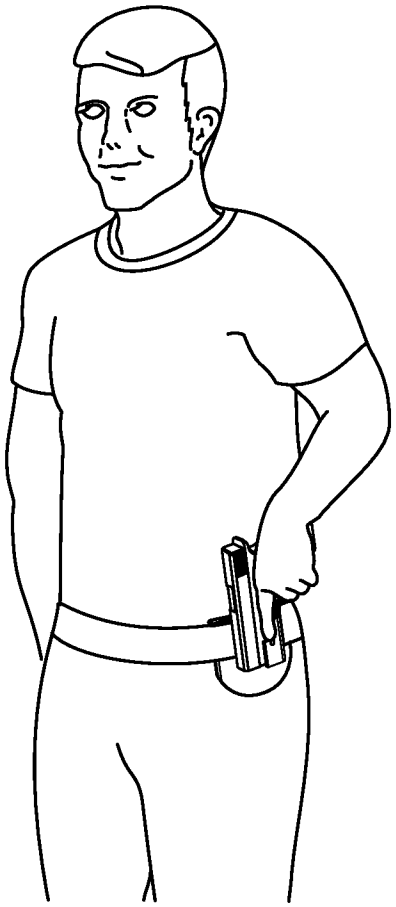
Figure 16A:
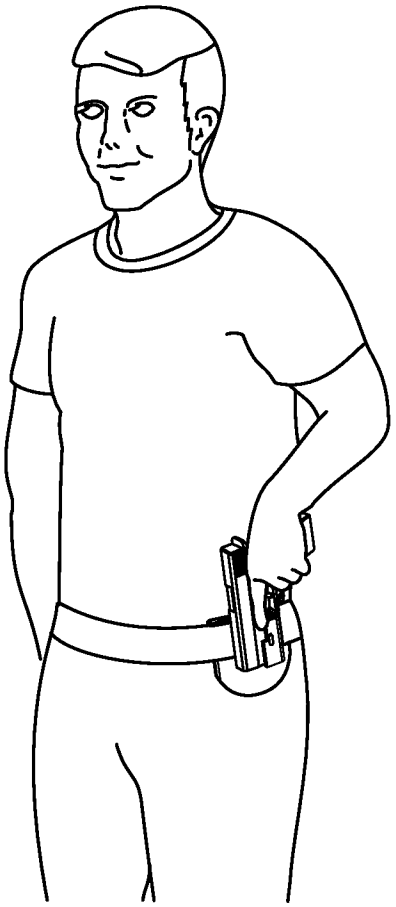

Referring now to FIG. 1, illustrates one embodiment of the holster described herein with the illustrating the different parts. FIGS. 2 and 3 shows the selector 102 in the "off" and "on" positions. FIGS. 4 and 5, illustrates the selector 102 and actuator 106 components in "off" and "on" positions respectively. In one embodiment, both the right and left actuators 106 are continuously biased inward under spring force, but only the left, (on actuator 106) can vary the amount of force available to the actuator 106, under control of the selector 102. For example in the on position the "on" actuator 106 will impart sufficient force to the XC-1 light control button to displace it into on position as it is drawn past the on actuator 106, yet imparting no effect to XC-1 L/S button when selector 102 reduces available spring for in Off position. In one embodiment, in the off position, the On actuator spring support 103 extends by spring force away from the On actuator 106 sufficiently reducing impartible force to related actuator 106. FIG. 6 shows the OFF actuator, this group is contained to Control Box 101 by (Off actuator spring retainer 104) and is not variably controllable. When XC-1 is returned to holster fully, it may stop with XC-1 light control button directly in line with Off actuator 106 and be maintained in off position.

In one embodiment, the present invention provides a holster that may be used in conjunction with a handgun and light accessory 107, such as an XC1 light accessory (Sure-Fire, Inc.) 107 for example. In another embodiment, the holster comprises a control component and a selector 102, wherein the selector 102 allows a user the option of drawing the handgun and light accessory 107 with the light on or off. In another embodiment, the control component further comprises one or more actuators 106. In another embodiment, the control component comprises an on actuator 106 and an off actuator 106. In another embodiment, the holster is described in FIG. 1-15 herein.

Referring now to FIGS. 7-10, illustrates several embodiments of the holster described herein illustrating the control box 101 with mounting assembly. Referring now to FIGS. 11-16, illustrates several embodiments of the holster described herein including description of the holster while it is used to carry the handgun.

It should be understood that the holsters and devices illustrated in FIGS. 1-16 are only some examples and that many other possible configurations and component configurations are contemplated.

In accordance with various embodiments herein, the present invention provides a holster that allows for a straight draw and/or return of a weapon to the holster, with no rotation of the weapon necessary. Thus, as readily apparent to one of skill in the art, the weapon may be drawn and used more effectively. Similarly, various embodiments described herein provide an uncomplicated mechanism that achieves a fixed or selective light actuation/deactivation, a design which, as readily apparent to one of skill in the art, is advantageous if the user is in a chaotic or stressful situation such as in combat. Further, unlike designs which have one actuator which pivots selectively on pin, various embodiments herein comprise two or more mechanical actuators which do not pivot on a pin, one of them can be restrained from effecting the ON switch function, thus allowing the user greater flexibility and control of a light accessory 107 for example; or, for example, enables a holster design that is stable enough to allow for a gun and light accessory to be securely holstered, while small enough to allow the gun and light accessory 107 to be concealed on the person.

The holster disclosed herein can be made using a variety of materials. In one embodiment, the holster may be made of a plastic material such as polyphenylene sulfide (PPS), polyethylene terephthalate, polyetheretherketone, polybutylene terephthalate, Ertalyte TX, PEEK, Torlon, Delrin, PET, Vespel, or Duratrol. In one embodiment, the holster is made from a Delrin mold. The holster disclosed herein works in a variety of conditions, for example under different weather conditions. Moreover, the holster disclosed herein may be used in conjunction with variety of models of pistols, and weapons, such as Tasers, etc. The holster may also be used in conjunction with variety of light accessories, such as laser sighting, flashlight. It is also contemplated that the holster can be used with waist strap, shoulder strap, leg strap, concealed or open carry, etc. In one embodiment, the holster disclosed herein incorporates straps, flaps, etc. that are used along with the holster.

Embodiments of the present disclosure are further described in the following examples. The examples are merely illustrative and do not in any way limit the scope of the invention as claimed.

EXAMPLES

Example 1

Model A of Holster

FIG. 1 illustrates one embodiment of an Exploded Parts View of the holster disclosed herein. The figure shows part count without springs and general orientation of parts, FIGS. 2 and 3 illustrate another embodiment of the holster disclosed herein showing the Selector in OFF and ON positions respectively.

FIGS. 4 and 5 illustrate another embodiment of the holster disclosed herein showing the Selector and Actuator components in OFF and ON positions respectively. In one embodiment, both Right and Left Actuators 106 are continuously biased inward under spring force, but only the Left, (ON Actuator) can vary the amount of force available to the Actuator 106, under control of the Selector. For example in the on position the ON Actuator will impart sufficient force to the XC-1 light control button to displace it into On position as it is drawn past ON Actuator 106, Yet imparts no effect to XC-1 L/S button when selector 102 reduces available spring for in Off position. In off position it can be noted that the (On Actuator Spring Support 103) extends by spring force away from (On Actuator 106) sufficiently reducing impartible force to related Actuator 106.

FIG. 6 illustrate another embodiment of the holster disclosed herein showing the OFF Actuator 106, this group is contained to Control Box 101 by (Off Actuator spring Retainer 104) and is not variably controllable. When the weapon, such as XC-1, is returned to holster fully, it would stop with XC-1 light control button directly in line with Off Actuator 106 and be maintained in off position.

In general, the device disclosed herein is designed to accept most pistols. In one embodiment, the device accepts a pistol that allows fitment of the Surefire XC-1 weapons light, and will support pistol mounted suppressors without increasing the uniquely short draw length. The device is in current form both Right and Left hand compatible, and as noted above controls the XC-1 lights ON/OFF function as drawn selectively without preparing XC-1 or chosen pistol. The holster will also allow a variety of carry options both concealed and open carry.

Example 2

Model B of Holster

FIGS. 7-15 illustrates other embodiment of the holster disclosed herein. In this case, the holster comprises of the control box, without the selector. In one embodiment, this is a small, minimalist design of a holster for a weapon. This new design allows for a straight draw or return of a weapon to the holster, without the need for any rotation. Moreover in this new design, the mechanism to achieve the fixed or selective light actuation/deactivation is less complicated. In one embodiment, the holster disclosed herein has two mechanical actuators 106, neither of which pivot on a pin. In one embodiment, one of the actuators 106 can be restrained from effecting the ON switch function.

The various methods and techniques described above provide a number of ways to carry out the invention. Of course, it is to be understood that not necessarily all objectives or advantages described may be achieved in accordance with any particular embodiment described herein. Thus, for example, those skilled in the art will recognize that the methods can be performed in a manner that achieves or optimizes one advantage or group of advantages as taught herein without necessarily achieving other objectives or advantages as may be taught or suggested herein. A variety of advantageous and disadvantageous alternatives are mentioned herein. It is to be understood that some preferred embodiments specifically include one, another, or several advantageous features, while others specifically exclude one, another, or several disadvantageous features, while still others specifically mitigate a present disadvantageous feature by inclusion of one, another, or several advantageous features.

Furthermore, the skilled artisan will recognize the applicability of various features from different embodiments. Similarly, the various elements, features and steps discussed above, as well as other known equivalents for each such element, feature or step, can be mixed and matched by one of ordinary skill in this art to perform methods in accordance with principles described herein. Among the various elements, features, and steps some will be specifically included and others specifically excluded in diverse embodiments.

Although the invention has been disclosed in the context of certain embodiments and examples, it will be understood by those skilled in the art that the embodiments of the invention extend beyond the specifically disclosed embodiments to other alternative embodiments and/or uses and modifications and equivalents thereof.

Many variations and alternative elements have been disclosed in embodiments of the present invention. Still further variations and alternate elements will be apparent to one of skill in the art. Various embodiments of the invention can specifically include or exclude any of these variations or elements.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

In some embodiments, the terms "a," "an," and "the" and similar references used in the context of describing a particular embodiment of the invention (especially in the context of certain of the following claims) can be construed to cover both the singular and the plural. The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified.

Preferred embodiments of this invention are described herein, including the best mode known to the inventors for carrying out the invention. Variations on those preferred embodiments will become apparent to those of ordinary skill in the art upon reading the foregoing description. It is contemplated that skilled artisans can employ such variations as appropriate, and the invention can be practiced otherwise than specifically described herein. Accordingly, many embodiments of this invention include all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

Furthermore, numerous references have been made to patents and printed publications throughout this specification. Each of the above cited references and printed publications are herein individually incorporated by reference in their entirety.

In closing, it is to be understood that the embodiments of the invention disclosed herein are illustrative of the principles of the present invention. Other modifications that can be employed can be within the scope of the invention. Thus, by way of example, but not of limitation, alternative configurations of the present invention can be utilized in accordance with the teachings herein. Accordingly, embodiments of the present invention are not limited to that precisely as shown and described.

What is claimed is:

1. A holster, comprising:

a control component comprising:

a first actuator located on a first side of the control component and adapted to control a first operation of an operably linked accessory attached to a weapon, and a second actuator located on an opposing second side of the control component and adapted to control a second operation of the accessory;

wherein the first actuator and the second actuator are biased inward under spring force for selective engagement with respective first and second buttons of the accessory; and wherein the control component is adapted to allow a user to draw the weapon with the accessory from the holster.

2. The holster of claim 1, wherein the weapon is a handgun.

3. The holster of claim 1, wherein the weapon is a Taser.

4. The holster of claim 1, wherein the accessory is a light accessory.

5. The holster of claim 4, wherein the light in the light accessory remains off when the weapon is in the holster.

6. The holster of claim 4, wherein the light in the light accessory remains off or activated on when the weapon is withdrawn from the holster.

7. The holster of claim 1, wherein the first actuator comprises an on actuator and wherein the second actuator comprises an off actuator.

8. The holster of claim 7, wherein the on actuator is attached to the control component by an on actuator spring support.

9. The holster of claim 7, wherein the off actuator is attached to the control component by an off actuator spring retainer.

10. The holster of claim 1, wherein the holster is adapted to receive a light accessory which has been attached to a handgun.

11. The holster of claim 1, wherein the holster allows for a straight draw or return of a weapon, no rotation is necessary.

12. The holster of claim 1, wherein at least one of the first actuator or the second actuator can be restrained from effecting an on switch function.

13. The holster of claim 1, wherein the control component includes one or more of the following materials: polyphenylene sulfide (PPS), polyethylene terephthalate, polyetheretherketone, polybutylene terephthalate, Ertalyte TX, PEEK, Torlon, Delrin, PET, Vespel, and Duratrol.

14. A holster, comprising:

a control component operably linked to a selector, the control component comprising:

a first actuator located on a first side of the control component and adapted to control a first operation of an accessory attached to a weapon, and a second actuator located on an opposing second side of the control component and adapted to control a second operation of the accessory;

wherein the first actuator and the second actuator are biased inward under spring force for selective engagement with respective first and second buttons of the accessory; and wherein the selector is adapted to allow a user to draw the weapon with the accessory from the holster.

15. The holster of claim 14, wherein the weapon is a handgun.

16. The holster of claim 14, wherein the weapon is a Taser.

17. The holster of claim 14, wherein the accessory is a light accessory.

18. The holster of claim 17, wherein the light in the light accessory remains off when the weapon is in the holster.

19. The holster of claim 17, wherein the light in the light accessory is activated on or allowed to remain off when the weapon is withdrawn from the holster.

20. The holster of claim 14, wherein the first actuator comprises an on actuator and wherein the second actuator comprises an off actuator.

21. The holster of claim 20, wherein the on actuator is attached to the control component by an on actuator spring support.

22. The holster of claim 20, wherein the off actuator is attached to the control component by an off actuator spring retainer.

23. The holster of claim 14, wherein the selector is adapted to receive a light accessory which has been attached to a handgun.

24. The holster of claim 14, wherein the selector is attached to a light accessory which has been attached to a handgun.

25. The holster of claim 14, wherein the holster allows for a straight draw or return of a weapon, no rotation is necessary.

26. The holster of claim 14, wherein the first actuator can be restrained from effecting an on switch function of the accessory.

27. A holster adapted to receive a handgun assembly comprising a handgun and a light accessory attached to the handgun, the holster comprising:

a control component comprising:

a first actuator located on a first side of the control component and adapted to control a first operation of the light accessory, and a second actuator located on an opposing second side of the control component and adapted to control a second operation of the light accessory;

wherein the first actuator and the second actuator are biased inward under spring force for selective engagement with respective first and second buttons of the light accessory; and wherein the first actuator and the second actuator are capable of moving between a neutral position and an engaged position as the handgun assembly is inserted into the holster, retained in the holster, or drawn from the holster.

28. The holster of claim 27, wherein a movement in at least one of the first actuator or the second actuator moves a switch in the light accessory to an off or on position as the handgun assembly is inserted into the holster, retained in the holster, or drawn from the holster.

29. The holster of claim 27, wherein the light accessory remains in the on or off position when the gun is drawn.

30. The holster of claim 27, wherein the light accessory remains in the off position when the handgun is in the holster.

31. The holster of claim 27, wherein the holster allows for a straight draw of the handgun.

32. A holster, comprising:

a control component operatively linked to a selector, the control component comprising:

a first actuator located on a first side of the control component and adapted to control a first operation of an accessory mounted to a weapon, and a second actuator located on an opposing second side of the control component and adapted to control a second operation of the accessory;

wherein the first actuator and the second actuator are biased inward under spring force for selective engagement with respective first and second buttons of the accessory; and wherein the holster allows a user to draw the weapon with the accessory.

33. The holster of claim 32, wherein the weapon is a handgun.

34. The holster of claim 32, wherein the weapon is a Taser.

35. The holster of claim 32, wherein the accessory is a light accessory and/or a laser.

36. The holster of claim 35, wherein the light in the light accessory remains off when the weapon is in the holster.

37. The holster of claim 35, wherein the light in the light accessory remains off or activated on when the weapon is withdrawn from the holster.

38. The holster of claim 32, wherein the first actuator comprises an on actuator and wherein the second actuator comprises an off actuator.

39. The holster of claim 38, wherein the on actuator is connected to the control component by an on actuator spring support.

40. The holster of claim 38, wherein the off actuator is connected to the control component by an off actuator spring retainer.

41. The holster of claim 32, wherein the holster is adapted to receive a light accessory which has been attached to a handgun.

42. The holster of claim 32, wherein the holster allows for a straight draw or return of a weapon, no rotation is necessary.

43. The holster of claim 32, wherein the first actuator can be restrained from effecting an on switch function of the accessory.

44. The holster of claim 32, further comprising a waist strap, a shoulder strap, and/or a leg strap.

45. The holster of claim 32, wherein the holster is adapted to be concealed.

46. The holster of claim 32, wherein the holster is adapted for open carry.

47. The holster of claim 32, further comprising one or more straps and/or flaps.

48. The holster of claim 1, further comprising a selector configured to adjust a spring pressure of at least one of the first actuator or the second actuator.

49. The holster of claim 48, wherein the selector is slidably connected to the control component, such that sliding movement of the selector relative to the control component selectively adjusts the spring pressure of the at least one of the first actuator or the second actuator.

50. The holster of claim 49, wherein a spring pressure of the second actuator is unchanged regardless of selector position.

51. The holster of claim 8, further comprising a selector connected to the control component, wherein the selector is configured to selectively limit movement of the on actuator spring support to adjust a spring pressure of the on actuator.

52. The holster of claim 27, further comprising a selector movably connected to the control component, such that movement of the selector relative to the control component selectively adjusts a spring pressure of at least one of the first actuator or the second actuator.

53. The holster of claim 39, wherein the selector is configured to selectively limit movement of the on actuator spring support to adjust a spring pressure of the on actuator.

54. A method comprising:

inserting a handgun assembly into a holster, wherein the handgun assembly comprises a handgun and a light accessory attached to the handgun, wherein the holster comprises a control component and a selector, wherein the control component comprises:

a first actuator located on a first side of the control component and adapted to control a first operation of the light accessory, and a second actuator located on an opposing second side of the control component and adapted to control a second operation of the light accessory, and wherein the first actuator and the second actuator are biased inward under spring force for selective engagement with respective first and second buttons of the accessory; and moving a switch of the light accessory to an off position in response to the inserting, wherein the moving is performed by a structure protruding from the control box, wherein the handgun assembly and holster allows for a straight draw of the handgun.

55. The method of claim 54, wherein the light accessory is allowed to remain in the off position once the handgun is withdrawn from the holster.

56. The method of claim 54, wherein the light accessory is activated once the handgun is withdrawn from the holster.

57. A holster, comprising:

a control component comprising:

a first actuator located on a first side of the control component and adapted to control a first operation of a light accessory attached to a weapon, a second actuator located on an opposing second side of the control component and adapted to control a second operation of the light accessory, and wherein the first actuator and the second actuator are biased inward under spring force for selective engagement with respective first and second buttons of the light accessory; and a selector adapted to allow a user to draw the weapon and the light accessory with the light accessory either off or activated on, and wherein the light accessory is turned off when the weapon is returned to the holster.

58. The device of claim 57, wherein the selector allows the holster to be configured for either a left or right handed user.

59. A holster, comprising:

a control component adapted to allow a user to draw a weapon having a light apparatus that can be turned off or activated on, wherein the control component comprises:

a first actuator located on a first side of the control component and adapted to control a first operation of the light apparatus, a second actuator located on an opposing second side of the control component and adapted to control a second operation of the light apparatus, and wherein the first actuator and the second actuator are biased inward under spring force for selective engagement with respective first and second buttons of the light apparatus; and an auto-shut off feature so that the light apparatus is turned off when returned to the holster.

60. The device of claim 59, wherein the device is made of a plastic material.

61. The device of claim 59, wherein the device includes one or more of the following materials: polyphenylene sulfide (PPS), polyethylene terephthalate, polyetheretherketone, polybutylene terephthalate, Ertalyte TX, PEEK, Torlon, Delrin, PET, Vespel, and Duratrol.

62. The device of claim 59, wherein the device is made from a Delrin mold.

* * * * *